US010364624B2

(12) United States Patent
Peveri et al.

(10) Patent No.: US 10,364,624 B2
(45) Date of Patent: Jul. 30, 2019

(54) APPARATUS FOR SWITCHING OFF AND DEVIATING A CIRCULATING LIQUID FLOW WITHOUT WATER HAMMERING

(71) Applicant: Schlumberger Technology Corporation, Sugar Land, TX (US)

(72) Inventors: Luigi Peveri, Fiorenzuola d'Arda (IT); Gian Marco Silva, Fiorenzuola d'Arda (IT)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/550,333

(22) PCT Filed: Jan. 12, 2016

(86) PCT No.: PCT/IB2016/000009
§ 371 (c)(1),
(2) Date: Aug. 10, 2017

(87) PCT Pub. No.: WO2016/116799
PCT Pub. Date: Jul. 28, 2016

(65) Prior Publication Data

US 2018/0002996 A1 Jan. 4, 2018

(30) Foreign Application Priority Data

Jan. 21, 2015 (IT) ..... MI2015A0057

(51) Int. Cl.
*E21B 21/08* (2006.01)
*E21B 21/10* (2006.01)
*E21B 21/00* (2006.01)

(52) U.S. Cl.
CPC ..... *E21B 21/106* (2013.01); *E21B 21/08* (2013.01); *E21B 2021/007* (2013.01)

(58) Field of Classification Search
CPC ... E21B 21/106; E21B 21/08; E21B 2021/007
See application file for complete search history.

(56) References Cited

U.S. PATENT DOCUMENTS

2011/0155379 A1 6/2011 Bailey et al.
2013/0068532 A1 3/2013 Bansal et al.
(Continued)

FOREIGN PATENT DOCUMENTS

WO 2015/110251 A1 7/2015

OTHER PUBLICATIONS

International Search Report and Written Opinion for the equivalent International patent application PCT/IB2016/000009 dated Mar. 31, 2016.

(Continued)

*Primary Examiner* — David J Bagnell
*Assistant Examiner* — Yanick A Akaragwe
(74) *Attorney, Agent, or Firm* — Jeffrey D. Frantz

(57) ABSTRACT

An apparatus for switching off and deviating a circulating liquid flow without water hammering, comprising an apparatus body (10) including an inlet channel (11) which is split into two outlet channels (12, 13) in which respective flow valves (14, 15) are arranged; said apparatus body comprises moreover a discharging channel (16) coupled to said outlet channels through respective discharging valves (17, 18); said outlet channels being moreover coupled to respective pressure measuring chambers (19, 20); a balancing valve (21) communicating two middle zones (22, 23) respectively formed in the outlet channels.

5 Claims, 2 Drawing Sheets

(56) References Cited

U.S. PATENT DOCUMENTS

2014/0299316 A1* 10/2014 Needham ..... E21B 47/00
166/250.01
2017/0260821 A1* 9/2017 Peveri ..... E21B 21/106

OTHER PUBLICATIONS

International Preliminary Report on Patentability for the equivalent International patent application PCT/IB2016/000009 dated Aug. 3, 2017.
Communication pursuant to Article 94(3) EPC for the equivalent European patent application 16702195.5 dated Oct. 22, 2018.

* cited by examiner

APPARATUS FOR SWITCHING OFF AND DEVIATING A CIRCULATING LIQUID FLOW WITHOUT WATER HAMMERING

BACKGROUND OF THE INVENTION

The present invention relates to an apparatus for switching off and deviating a circulating liquid flow without water hammering.

This apparatus has been specifically designed to be used in a valve assembly applied in drilling systems, for preventing the liquid flow from being shut off as the drilling rods are changed.

As is known, drilling systems conventionally use drilling rods, or pipes, into which a drilling fluid (or drilling mud) is pumped so designed as to hold controlled ground hydrostatic properties, to allow drilled waste materials to exit soil, and moreover to properly lubricate and reduce the temperature of the drilling implement, thereby extending the useful life and efficiency of the latter.

The mud hydraulic circuit is a closed system and constists of a tank, one or more pumps, a duct and valve system (probe manifold) to direct the liquid flow through the well being drilled.

More specifically, the drilling mud passes through a driving head and is conveyed into the drilling rods up to the drilling implement or bit, from which it is ejected to perform the above mentioned operations.

Then, the ejected mud is caused to move upward through the well, in the gap between the drilling rods and the borehole up to the well surface where it is conveyed through further ducts and valves to further devices operating for filtering and reconditioning the used drilling mud, to be then sent to the mud tank in order to be pumped again through the well circuit.

As a new drilling rod is applied to or removed from the drilling string, it is necessary to shut off the fluid circulation.

This operation is a rather dangerous one since, during the switching off of the mud pumps and upon stopping the mud flow conveyed through the well, inside the drilled borehole a pressure compensating cycle operation occurs, due to the change of the pressure load or stress arrangements from a dynamic to a static liquid condition, which could cause a lot of drawbacks, among which an accidental and uncontrolled soil fracturing.

SUMMARY OF THE INVENTION

Accordingly, the aim of the present invention is to provide such an apparatus specifically designed for switching off and deviating a circulating liquid flow without water hammering, thereby overcoming the above mentioned drawbacks of the prior art.

Within the scope of the above mentioned aim, a main object of the present invention is to provide a valve assembly, specifically designed for well drilling systems, characterized in that it comprises a bidirectional valve device cooperating with hydraulic clamping means applied to a well drilling machine, so as to allow a drilling fluid to be conveyed through a well according to two discrete directions.

Another object of the present invention is to provide such a highly safe drilling apparatus, overcoming a need of performing manual operations on the probe manifold valves included in the drilling system.

Yet another object of the present invention is to hold the mud circuit characteristics unchanged while preventing any wearing of the drilling system.

Yet another object of the present invention is to provide such an apparatus which, owing to its specifically designed structural features, is very reliable and safe in operation.

According to one aspect of the present invention, the above mentioned aim and objects, as well as yet other objects, which will become more apparent hereinafter, are achieved by an apparatus for switching off and deviating a circulating liquid flow without water hammering, characterized in that said apparatus comprises an apparatus body including an inlet channel which is split into two outlet channels, in which respective flow valves are arranged.

Said apparatus body comprises moreover a discharging channel coupled to said outlet channels through respective discharging or outlet valves.

Said outlet channels are moreover coupled to respective pressure measuring chambers.

A balancing valve communicates with one another two respective middle zones, respectively formed in the outlet channels.

BRIEF DESCRIPTION OF THE DRAWINGS

Further characteristics and advantages of the present invention will become more apparent hereinafter from the following detailed disclosure of a preferred, though not exclusive, embodiment of the invention which is illustrated, by way of an indicative but not limitative example, in the accompanying drawings, where.

DESCRIPTION OF THE PREFERRED EMBODIMENTS

Figure 1:
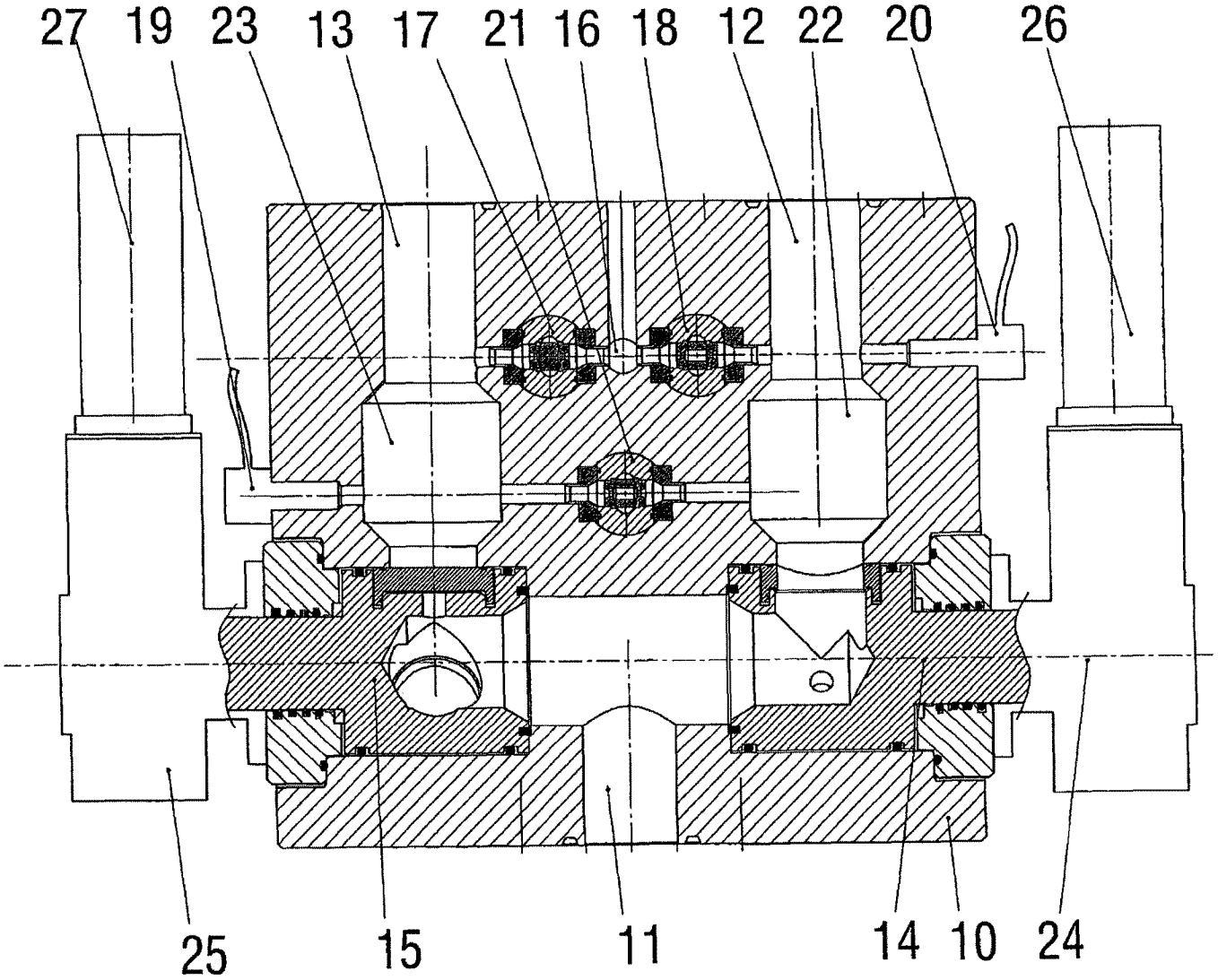
FIG. 1 is a schematic view of the apparatus according to the present invention, in which are clearly shown the valve assemblies and flow channels passing therethrough.
Figure 2:
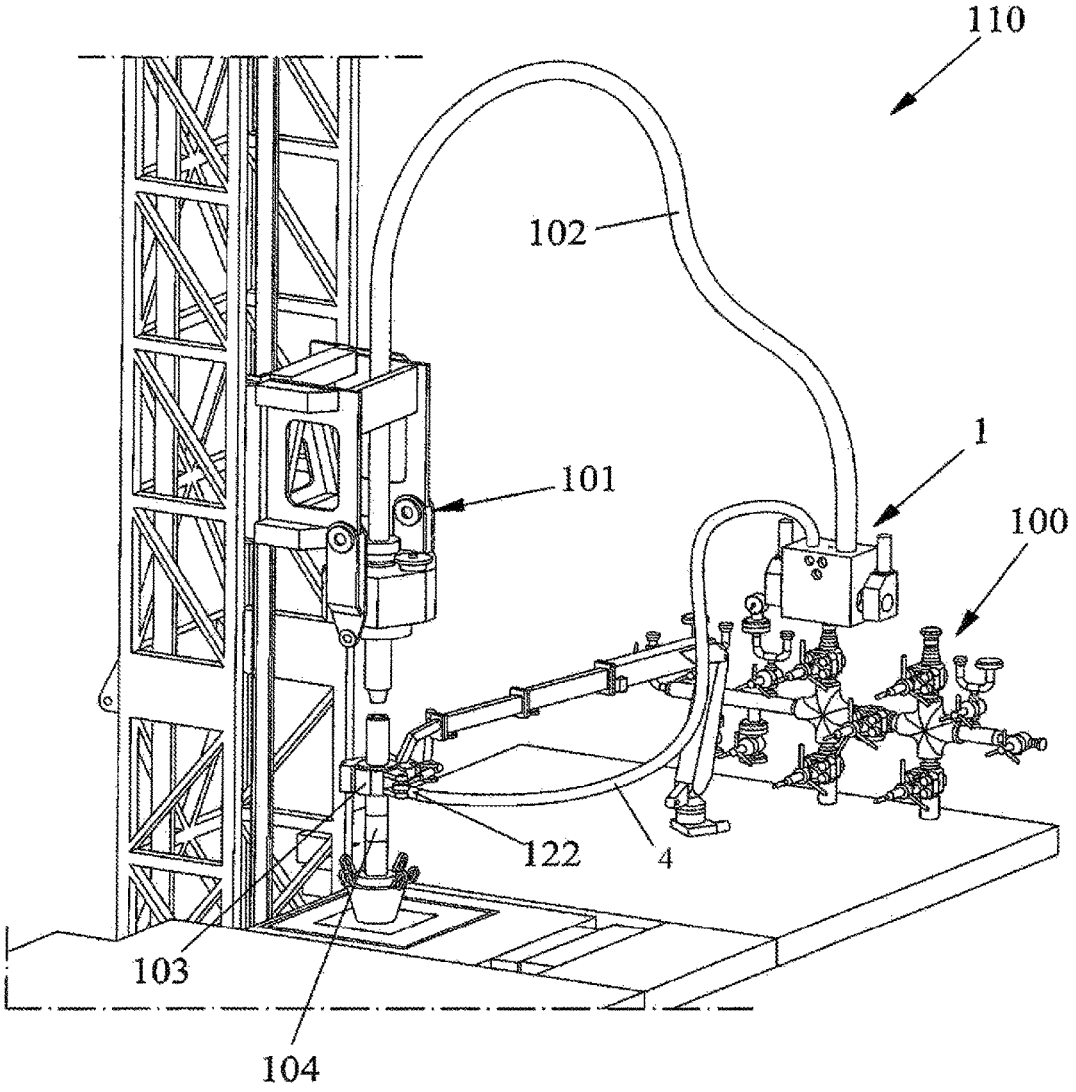
FIG. 2 is a perspective view of the probe arrangement of a drilling system, in which are shown the probe manifold, the driving head, and the apparatus according to the present invention arranged on the probe manifold, as well as the driving head connecting tubes, and a further valve assembly including a clamping arrangement and a connecting flexible pipe.

With reference to the number references of the above figures, the apparatus for switching off and deviating a circulating liquid flow without water hammering according to the present invention, which has been generally indicated by the reference number 1, has been specifically designed for application to a probe manifold 100 of a drilling system, generally indicated by the reference number 110, which comprises a driving head 101 coupled to the apparatus 1 through a coupling duct 102.

The apparatus 1 is moreover connected to a valve assembly 122, comprising a clamping unit 103, by means of a flexible coupling hose 4.

Advantageously, the valve assembly 122 comprises a bidirectional valve device cooperating with said hydraulic clamping unit 103, to allow drilling fluid to be supplied in two discrete supplying directions.

The valve assembly 122 is of a type disclosed in Italian Patent Application No. MI2014A001725 in the name of the same Applicant.

According to the present invention, the apparatus 1 comprises moreover an apparatus body 10, preferably constituted by a forged block, in which an inlet channel 11 branching into two outlet channels 12 and 13 through an interposition of respective flow valves 14 and 15 is formed.

Said flow valves 14 and 15 are controlled by respective actuators 24 and 25 including actuator cylinders 26 and 27, respectively.

The apparatus body 10 comprises moreover a discharging channel 16, coupled to the outlet channels 12 and 13 through respective discharging or outlet valves 17 and 18.

The outlet channels 12 and 13 are moreover coupled to respective pressure measuring chambers 19 and 20 each including a pressure measuring system.

A balancing valve 21 communicates two middle zones, indicated by the reference numbers 22 and 23, respectively formed in the outlet channels 12 and 13.

The five built-in valves 14, 15, 17, 18 and 21 divide the inner space into four zones.

The two flow valves 14 and 15 communicate with the delivery zone, the balancing valve 21 communicates the two middle zones 22 and 23 with one another, and the two discharging or outlet valves 17 and 18 communicate with the discharging or outlet zone 16.

The valves are controlled by a central control unit, not shown in the figures, which operates based on information received by pressure switch assemblies.

The apparatus according to the present invention allows to convey the drilling mud circulating fluid toward the driving head 101 during the drilling or rod 104 withdrawing steps, or to deviate the flow toward the hydraulic clamping unit 103, and accordingly into the valve assembly 122, as a new rod or rod string is applied to or removed from the battery 104.

It should be pointed out that, even if such a rod changing operation could also be made using the probe manifold valves, this would require a comparatively large physical effort by the probe personnel, and would imply a high wearing of the components, which usually are not specifically designed for a frequent use of opening and/or closing operating cycles.

The apparatus 1 is series arranged in the main mud circulating line, above the probe manifold 100, without modifying or impairing a use of the conventional circuit.

Thus, the drilling system is held unchanged, even if it passes through the apparatus 1 during the drilling rod applying or withdrawing operations, i.e. as the mud circulation is performed from the driving head.

In a rod changing operation it is necessary to perform a series of operating steps to allow the system to held the mud hydraulic circuit in a closed condition.

More specifically, it is preferred to arrange, between the drilling rods, the valves assemblies 122 of the type disclosed in Italian Patent Application No. MI2014A001725, and the hydraulic clamping unit 103.

The connection of said hydraulic clamping unit 103 to the valve assembly 122 allows, in cooperation with said valve assembly, a mud circulation both according to a radial direction and according to an axial direction.

After having coupled the hydraulic clamping unit 103 to the valve assembly 122, it is possible to direct, by using the inventive apparatus 1, the mud flow in a radial direction of the valve assembly 122, thereby allowing the line coming from the driving head 101 to be disconnected.

In particular, the method for applying or removing one or more drilling rods in a drilling system comprises the following steps:

i. putting the system in a circulating mode of operation from the driving head 101 with the flow valve 14 in an open condition and with all the other valves in closed condition;

ii. radially connecting a the hydraulic clamping unit 103 to the valve assembly 122;

iii. opening the balancing valve 21 thereby filling-in the mud and pressurizing the pipe 4 between the apparatus 1 and the hydraulic clamping unit 103;

iv. detecting, upon filling-in, the achieving of a target pressure by one of the two pressure measuring instruments applied in the chamber 19;

v. closing the central balancing valve 21;

vi. opening the flow valve 15 in a radial direction of the valve assembly 122;

vii. causing a circulation in two directions in the pipe 4 and assembly 122, through the flow valves 14 and 15, the driving head 101 and the hydraulic clamping unit 103, in the axial and radial directions of the valve assembly 122;

viii. closing the flow valve 14 to shut off the circulation in the driving head 101 direction;

ix. holding in a separated and pressurized condition the pipe 102 between the apparatus 1 and the driving head 101, to allow the pressure measurement instrument or gauge 20 to display the apparatus operating status;

x. discharging, through one of the discharging or outlet valves 18, the pressure held between the apparatus 1 and the driving head 101 (and the last withdrawn rod, if a rod withdrawing operation is performed);

xi. upon having displayed the pressure measurement which should correspond to the environment pressure, closing the discharge or outlet valve 19;

xii. causing a mud circulation through the radial valve of the valve assembly 122; thereby reducing the pressure on the bidirectional valve to the environment pressure, thereby allowing a disconnection of the driving head 101 line and an application of a new rod or a removal of a withdrawn rod;

xiii. upon applying or withdrawing the rod, reconnecting the driving head 101 to the drilling rods 104;

xiv. opening the balancing valve 21 to fill-in and pressurize the tube 102 between the apparatus 1 and the valve assembly 122;

xv. allowing the pressure sensor 20 to display the achievement of the working pressure in the outlet channel 12 and accordingly in the pipe 102;

xvi. thereby the valve assembly 122 will have the same pressure in both the axial and radial directions, while limiting the axial flow through the driving head 101, owing to the small size of the balancing valve 21, which is closed immediately after an achievement of the working or operating pressure;

xvii. opening the flow valve 14, in the driving head 101 direction, with a consequent opening of the valve in an axial direction of the valve assembly 122;

xviii. closing the flow valve 15, in the radial direction, thereby holding the pipe 4 and the hydraulic clamping unit 103 in segregated pressure conditions;

xix. discharging the segregated pressure through the discharging valve 17 up to the environment pressure;

xx. opening the hydraulic clamping unit 103 and performing conventional drilling operating steps.

Then, the method is continued, restarting from the method step i. the drilling or rod withdrawing operations, up to the operating time at which the following valve assembly will arrive at the probe level height, and a new sequence of the operating steps from the operating step ii. shall be performed.

It has been found that the invention fully achieves the intended aim and objects.

In fact, the invention has provided a drilling apparatus which, being used in cooperation with a hydraulic clamping unit and a valve assembly, allows to provide a very safe operation, since it does not require to switch off the mud pumps as the drilling rods are changed.

The present apparatus, moreover, reduces to a minimum a wearing of the probe manifold components.

Furthermore, the apparatus according to the present invention also allows to greatly reduce the operating cost and to increase the safety, since the disclosed automatized operations allow to reduce to a minimum the probe personnel requirements.

Yet another great advantage of the present invention is that the inventive apparatus has a reduced size and may be easily shipped and replaced.

In practicing the invention, the materials used, as well as the contingent size may be any, according to requirements.

The invention claimed is:

1. An apparatus for switching off and deviating a circulating liquid flow without water hammering, the apparatus comprising:

an apparatus body having:

an inlet channel that is split into a first outlet channel having a first flow valve arranged therein and a second outlet channel having a second flow valve arranged therein;

a discharging channel coupled to the first outlet channel, through a first discharging valve, and the second outlet channel, through a second discharging valve; and a balancing valve communicating with a first middle zone formed in the first outlet channel and a second middle zone formed in the second outlet channel such that the balancing valve is in fluid communication with the first outlet channel and the second outlet channel, wherein the apparatus body has a first side and an opposite second side, the inlet channel opens at or on the first side of the apparatus body, the first and second outlet channels open at or on the opposite second side of the apparatus body, the balancing valve is located closer to the first side of the apparatus body than the first and second discharging valves such that the balancing valve is provided or located between the first and second discharging valves and the first side of the apparatus body having the inlet channel, and all flow paths providing fluid communication from the inlet channel to the balancing valve consists of a first flow path from the inlet channel through the first flow valve to the balancing valve via the first middle zone formed in the first outlet channel and a second flow path from the inlet channel through the second flow valve to the balancing valve via the second middle zone formed in the second outlet channel.

2. The apparatus according to claim 1, further comprising:

a central control unit for driving and controlling the operation of at least pressure switches associated with the first and second pressure measuring chambers.

3. The apparatus according to claim 1, wherein the apparatus is connected in series in a main mud circulating line coupled upstream of a probe manifold, without modifying or negatively affecting use of the conventional circuit.

4. The apparatus according to claim 1, wherein the apparatus is coupled to a drilling system such that the apparatus conveys drilling mud circulating flow to a driving head of the drilling system, during drilling operating steps or drilling rod withdrawing steps of the drilling system, or in that the apparatus switches the mud flow toward a bypass circuit as a new drilling rod or rod string is either applied to or removed from a battery.

5. A method for applying or removing one or more drilling rods in a drilling system, the method comprising:

providing an apparatus having an apparatus body comprising:

an inlet channel that is split into two outlet channels in which respective flow valves are arranged, wherein the two outlet channels are coupled to respective pressure measuring chambers;

a discharging channel coupled to the two outlet channels through respective discharging valves; and a balancing valve communicating two middle zones respectively formed in the outlet channels;

radially connecting a hydraulic clamping unit to a valve assembly;

opening and pressurizing a radial channel through the balancing valve of the apparatus;

closing the balancing valve of the apparatus and opening at least one flow valve of the apparatus;

switching off the flow in an axial direction and releasing the pressure;

disconnecting a drilling battery or assembly while inserting or withdrawing a drilling rod string;

reconnecting the drilling battery or assembly and pressurizing by the balancing valve of the apparatus;

closing the balancing valve of the apparatus and opening at least one flow valve of the apparatus in an axial direction;

closing and releasing pressure in the valve assembly radial direction; and resuming a withdrawing or drilling operations.

* * * * *